United States Patent [19]

Tayebi

[11] Patent Number: 4,641,645

[45] Date of Patent: Feb. 10, 1987

[54] FACE MASK

[75] Inventor: Amad Tayebi, Westford, Mass.

[73] Assignee: New England Thermoplastics, Inc., Lawrence, Mass.

[21] Appl. No.: 754,955

[22] Filed: Jul. 15, 1985

[51] Int. Cl.[4] ..... A62B 7/00

[52] U.S. Cl. ..... 128/206.19; 128/206.24

[58] Field of Search ..... 128/205.29, 206.12, 128/206.13, 206.19, 206.21, 206.24, 206.28, 207.11

[56] References Cited

U.S. PATENT DOCUMENTS

| | | | |
|---|---|---|---|
| 1,142,990 | 6/1915 | Stern | 128/206.16 |
| 2,344,669 | 3/1944 | Barker et al. | 128/206.15 |
| 2,787,264 | 4/1957 | Thiebault et al. | 128/206.19 |
| 3,220,409 | 11/1965 | Liloia et al. | 128/206.19 |
| 4,248,220 | 2/1981 | White | 128/206.19 |
| 4,319,567 | 3/1982 | Magidson | 128/206.19 |
| 4,384,577 | 5/1983 | Huber et al. | 128/206.19 |
| 4,454,881 | 6/1984 | Huber et al. | 128/206.15 |

FOREIGN PATENT DOCUMENTS

| | | | |
|---|---|---|---|
| 491273 | 2/1930 | Fed. Rep. of Germany | 128/206.24 |

*Primary Examiner*—Henry J. Recla

*Attorney, Agent, or Firm*—Joseph E. Funk

[57] ABSTRACT

What is disclosed is a face mask formed from a porous sheet made of a plurality of fibers. The mask is formed into a generally cup shape shell that fits over the mouth and nose of the wearer and is held thereto by elastic straps attached to the mask that pass behind the head when the mask is worn. The mask filters breathed air passing through the mask. The border of the mask is more tightly compacted during forming. The mask of the present invention features rearwardly projecting portions located on either side of the nose bridge area of the mask parallel to and close to the border of the mask. The peak of the rearwardly projecting portions extend from the face mask in the direction of the face of the wearer of the mask to conform the portion of the mask close to its border to the contours of the face of the wearer between the bridge of the wearer's nose and the upper areas of their cheekbones. The more tightly compacted rearwardly projecting portions, rib elements and border cooperate to provide shape retention to the mask, and to provide a spring action that holds the mask firmly but comfortably to the face of the wearer even when they talk or change facial expression to prevent the passage of air between the mask and the face of the wearer.

1 Claim, 12 Drawing Figures

ALTERNATE EMBODIMENT

VIEW D-D

FACE MASK

FIELD OF THE INVENTION

The present invention relates to face masks that cover the nose and mouth while filtering breathed air and, in particular, face masks molded or thermoformed from fibrous sheet materials.

BACKGROUND OF THE INVENTION

In the prior art, molded or thermoformed face masks that cover the nose and mouth have been constructed of layers of fibrous sheet material and have found numerous applications in dirty or dusty environments, particularly in industry, but have also found use in areas of medicine such as with surgical masks. These masks are held on the face by one or more elastic bands or straps attached mechanically (such as by stapling), or by thermal fusing to the sides of the face mask to hold the mask to the face and to accomplish sealing of the mask over the nose and mouth. One desireable criterion of this type of mask is that it completely seals around the nose and mouth and allows no air to pass between the mask and the face. Too often, however, due to the softness and flexibility of fibrous sheet materials from which masks are molded, and due to the curved contour of the face between the bridge of the nose and the cheekbones, complete sealing around the bridge of the nose and mouth is not achieved except by making the masks more complex, which typically increases their cost. To solve this problem one technique is to affix foam rubber strips on the inner surface of the masks in the nose bridge area to achieve extra sealing. This is an extra manufacturing step that raises cost. Another technique to solving the sealing problem, though adding more complexity and manufacturing cost, is to affix a plastically deformable soft metal strip or clip on the outer surface of the mask on the nose bridge area, which strip or clip is squeezed over the bridge of the nose after the mask is put on to hold the mask to the face in the area around the nose. However, the use of the soft metal strip or clip is uncomfortable to some people because it doesn't easily adapt to changes in facial contours around the nose caused by facial movement due to speech or change of facial expression. Also, when there is a change in facial contour caused by speech or changed facial expression there is a tendency for air to leak between the face and the mask between the nose and cheekbones. This leakage fogs eyeglasses and safety glasses worn by the wearer of the mask, which is a detriment. To make the metal clip of a harder material which has more of a spring quality is not a solution since it introduces other problems. Furthermore, the use of a metal strip dictates that the user wear the mask over a high point on the nose in order to avoid excessive pressure over the nostrils which is undesireable. All these and other problems with prior art masks introduce another problem. It can be appreciated that if a mask is uncomfortable to wear, or creates a problem such as fogging, too often workers will not wear them even though use of a filter mask is dictated by the environmntal conditions in which the workers work.

In an attempt to eliminate the need for affixing foam rubber inserts on the inner surface of masks in the nose bridge area, and to attempt to eliminate the need for a metal clip or strip on the nose bridge portion of a mask, both done to achieve proper sealing, in the mask forming or molding process the prior art teaches more lightly compacting the fibrous sheet material from which the masks are fabricated in an area along the nose pad portions and the cheekbone areas of the mask as taught in U.S. Pat. No. 4,319,567 and shown in U.S. Pat. No. Des. 267,985. This, however, reduces the stiffness and shape retention capability of the mask in the area of the nose bridge portion. To compensate for this, the prior art also teaches (as shown in U.S. Pat. No. 4,384,577) forming or molding an elongated ridge member extending along and spaced from the edge or periphery of the mask and extending across the nose bridge portion of the mask between the nose pad portions on either side thereof to produce a spring action that enhances sealing between the mask and the wearer's face. However, all prior art mask shapes and varied compaction of the fibrous media from which the masks are formed for enhancement of the seal between the wearer's face and the mask utilize a planar mask periphery profile in the nose bridge—nose pad—upper cheekbone area. In contrast, the contour of the human face between the top of the nose and the upper part of the cheekbone is not a straight line. In fact, a straight line connecting any point in the upper cheekbone area and extending tangentially to the nose bridge shows a gap between the wearer's face contour and the straight line. The width of such a gap increases as the tangential line is moved downwards toward the tip of the nose.

The prior art also teaches the use of a molded, rubber like bead member extending around the periphery of a mask for providing a seal between the face of the wearer and the mask, as taught in U.S. Pat. No. 4,454,881.

Thus, there is a need in the art for a molded or thermoformed face mask that doesn't require extra manufacturing steps such as adding foam rubber or deformable soft metal strips in order to conform the mask to the contour of the human face and provide effective sealing, particularly in the area between the bridge of the nose and the cheekbones of the wearer of the mask. There is a need in the art for a mask that doesn't require extra manufacturing equipment, and the resulting extra manufacturing costs due to material and handling. There is also a need for a mask that eliminates the complexities and problems of prior art masks.

SUMMARY OF THE INVENTION

The novel thermoformed face mask described herein solves these numerous problems of the prior art. No metal clips, foam rubber pieces, or any other elements need be added to a simply molded or thermoformed mask, yet the novel mask conforms to the curved contour of the human face and provides an effective air seal between the entire periphery of the mask and the face, particularly in the area between the bridge of the nose and the cheekbones, even as the wearer talks or changes facial expression that change the contour of their face. To achieve this conformity of the mask to the human face, a narrow area parallel to the periphery of the mask between the top of the nose bridge portion and both the upper cheekbone portions of the mask adjacent thereto are shaped not to lie in a plane with the rest of the periphery of the mask in the nose bridge-cheekbone portion of the mask. Rather, in this narrow area on either side of the nose bridge portion of the novel mask is formed during manufacture a rearward projecting portion that extends in the direction of the face beyond the plane formed by the periphery of the mask between the top of the nose bridge portion and both the upper cheekbone portions of the mask adjacent thereto. These rearward projecting portions start in the same plane as the periphery of the mask near the nose bridge portion of the mask, rise to a peak as the distance increases from the nose bridge portion, and then decreases back to the same plane as the periphery of the mask as the periphery area of the mask by the cheekbones of the wearer is reached. These formed rearward projecting portions shape the mask to the curved contour of the human face between the bridge of the nose and the cheekbones. This must be done because the surface of the face between the bridge of the nose and the cheekbones is not a straight line and doesn't lie in a plane. These rearward projecting portions may advantageously be in the form of arcuate ridge portions, and each may advantageously have a peak and valley on either side thereof that create a corrugated effect that provides rigidity which creates a spring action to hold the novel arctuate ridge portions near the periphery of the novel mask against the sides of the nose and the cheekbones, even with variable facial contours caused by somewhat different face shapes, and by facial movement resulting from speech or change in facial expression.

In prior art masks the mask configuration is such that any projections, ridges, ribs or other means provided for improving fit, structural stiffness, or seal between the mask perimeter and the wearer's face, are formed within or inside the mask shell and do not extend rearward in the direction of the face of a wearer of the mask beyond the periphery of the mask shell.

In the present novel mask, the rearward projecting portions extend rearward beyond the periphery of the mask shell in a direction substantially opposite to that of the formed mask shell. The rearward projecting portions are advantageously located generally along the periphery or perimeter of the mask shell. The rearward projecting portions may be formed inwardly or outwardly, and may be in the form of arcuate ridges or arcuate flaps.

BRIEF DESCRIPTION OF THE DRAWING

The present invention will be better understood upon reading the following detailed description in conjunction with the drawing in which.

DETAILED DESCRIPTION

Figure 1:
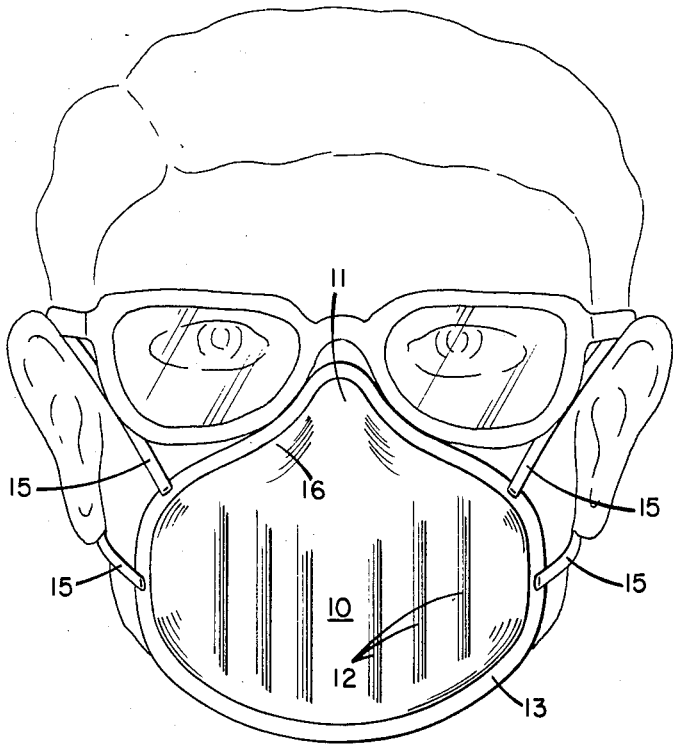
FIG. 1 is a front view of a person wearing a molded or thermoformed face mask which utilizes the present invention.

The present invention is directed to an improved face mask of the type commonly worn in industrial applications to filter airborne dust and other particle contaminates from air that is breathed. In the preferred embodiment of the invention the mask is fabricated of a commercially available synthetic fiber nonwoven material marketed under the registered trademark VILEDON MICRODON by Carl Freudenberg Company. This material is made up of three layers. The first layer is the outer surface of the mask and is a non-woven polyester web that serves as a pre-filter. The middle layer is made up of electrostatically charged polycarbonate microfibers and provides filtration for the smallest particle sizes. The electrostatic charge in the middle layer enhances the effectiveness of filtration by precipitating the airborne particulates. The third layer is on the inside of the mask and is also a non-woven polyester web. The third layer also provides filtration. These three layers of synthetic material are assembled together into one composite mat. When molded or thermoformed into the present face mask the material is permanently set and retains its molded or thermoformed shape so it is not necessary to use a carrier means for shape retention. Other filter material may be used alone or in combination with other similar or dissimilar materials as a composite material used to fabricate the mask that include activated charcoal, fiberglass material, electrostatically charged material such as made from fine denier nonwoven polyethelene or polypropylene fibers, polycarbonate, and natural fibers such as wool.

To form the mask the above identified commercial material from which the mask is fabricated is placed between matched mold halves which form the cup shape of the mask, including the novel rearward projecting portions in accordance with the teaching of the present invention. The mold halves, which are heated, close on the material under pressure. Heat is transferred from the two mold halves to the mask forming material in order to set the mask in the desired configuration which is a generally cup-shaped shell. Portions of the mask are compacted more than other portions depending on the space between the two halves of the mold when they are closed under pressure on the material being thermoformed. The portions of the mask that are more tightly compacted are more rigid and introduce shape retention to the mask. The heat applied to the two halves of the mold during the forming process is enough to fuse some of the non-woven fibers together to enhance this compaction and rigidity. In molding or forming the mask utilizing the present invention more heat is applied to the mold than is done in the prior art. The fusing of more synthetic fibers together by the higher heat level does not interfere with the flow of air through the mask. The particular choice of increased compaction of certain areas of the mask, and increased bonding of some of the synthetic fibers due to higher forming temperatures and compaction during molding provides for the mask to have sufficient structural strength so as to retain its molded shape even after being folded. Workers utilizing such face masks sometimes remove them, fold them and put them in their pockets when they are away from their work site where the mask is needed.

There are areas of the mask 10 that are preferably more tightly compacted than other areas to provide structural strength giving shape retention, and to implement the invention. They are: the periphery 13 of the mask 10, substantially parallel rib elements 12 formed on the central portion of the mask, and the novel rearward projecting portions 16 on either side of the nose bridge portion 11 of the mask. The tightly compacted rearward projecting portions 16 are formed in a narrow area substantially parallel to the periphery 13 of the mask 10 between the top of the nose bridge portion 11 and both the upper cheekbone portions adjacent thereto. These rearward projecting portions 16 are formed not to lie in a plane with the periphery 13 of the mask 10 in the upper cheekbone—nose bridge area of the mask. These formed rearward projecting portions 16 extend from the mask 10 in the direction of the face beyond the plane A formed by the periphery 13 of the mask 10 in the nose—cheekbone portion of the mask, and they shape the mask 10 to the contour of the human face between the bridge of the nose and the cheekbones in accordance with the teaching of the present invention. This compensates for the fact that the periphery 13 of the mask 10 lies in a plane A while the contour of the human face between the bridge of the nose and the cheekbones does not lie in a plane.

Figure 6:
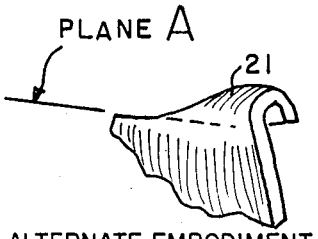
FIG. 6 is a perspective cutaway of an inwardly formed arcuate ridge having a peak and a valley of an alternate embodiment of the present invention, and showing its shape and how it extends rearward beyond the plane A of the periphery of the mask.

These rearward projecting portions preferably are in the form of arctuate ridges 16, each having a peak 21 and a valley 22 on either side thereof that create a corrugated effect that also provides rigidity which creates a spring action to hold the novel arctuate ridge portions near the periphery 13 of the novel mask 10 against the sides of the nose and the cheekbones even with variable facial contours caused by somewhat different face shapes, and by facial movement resulting from speech or change in facial expression. Alternatively, the rearward projecting portions 16 may be in the form of arctuate flaps, such as shown in FIG. 6, extending rearward from the mask shell in the direction of the face beyond the plane formed by the periphery of the mask in the nose—cheekbone portion of the mask such that the arctuate flaps shape the mask to the contour of the human face between the bridge of the nose and the cheekbones.

It has been found that with the mask disclosed herein the combination of a substantially planar periphery for the mask shell, in combination with a highly compacted border around the periphery of the mask results in a significant improvement in shape retention of the mask shell. This is particularly desirable where the wearer may take the mask off, fold it and place it in their pocket for later use.

It has also been found that the use of arctuate ridges as rearward projecting portions results in a significant improvement in the structural stiffness, and hence in shape retention of the mask, as compared to the use of arctuate flaps as rearward projecting portions. This improvement in structural stiffness of the mask might be attributed to the increased area moment of inertia of the cross section of the arctuate ridges.

In addition, it has been found that tightly compacting the material in the rearward projecting portions (particularly with arctuate ridges) provides improved structural stiffness and shape retention of the mask shell, as well as improved spring action to hold the rearward projecting portions and the periphery of the mask shell against the nose and face of the wearer to either side of their nose.

Further, it has also been found that the use of an elongated arctuate ridge extending across the nose bridge portion of the mask between the arctuate ridges improves the spring action holding the nose bridge portion of the mask against the nose and face of the wearer.

It is an advantageous feature in face masks to provide as much uncovered area around and below the wearer's eyes as possible in order to permit wearing eye glasses or safety glasses while wearing the face mask. Therefore, it is desirable to have the face mask nose bridge portion ride on the wearer's nose at a point as close to the wearer's nose tip as possible. Wearing prior art face masks utilizing metal strips over the nose bridge portion of the mask usually causes wearer discomfort at a point close to the nose tip (and particularly over the nostrils), and hence dictates wearing the mask to engage the nose bridge portion at a high point on the wearer's nose bridge. Other prior art masks, though not utilizing metal strips over the nose bridge portion, achieve sealing between the mask and the contour of the wearer's face by pulling the mask towards the wearer's face to engage the periphery of the face mask to the contours of the wearer's face. In effect, the pulling force deforms both the face mask perimeter and the wearer's face contour in order to achieve a seal between the face mask and the wearer's face. The use of a high level of pulling force makes it uncomfortable for the wearer to wear the face mask low on the nose. According to the present invention, the seal between the mask and the wearer's face is accomplished by naturally fitting, flexible, easily deformable, rearward projecting portions which fill the gap between the wearer's face contour and the straight line connecting any point on the wearer's upper cheekbone area and extending tangentially to the wearer's nose bridge. This makes it possible to wear the mask utilizing the present invention closer to the wearer's nose tip without discomfort or excessive pressure on the nostrils, and without restriction of free air passage while obtaining an effective seal and ample uncovered area below the wearer's eyes to accomodate wearing glasses.

A significant feature in the face mask formed in accordance with the present invention is that the rearward projecting portions readily deform or deflect to fill the gap between the wearer's face contour and the straight line connecting any point on the wearer's upper cheekbone area and extending tangentially to the wearer's nose bridge. Because of this feature it is possible to use a single size face mask and provide good comfortable fit and an effective seal between the mask and varying wearer's face contours.

Figure 7:
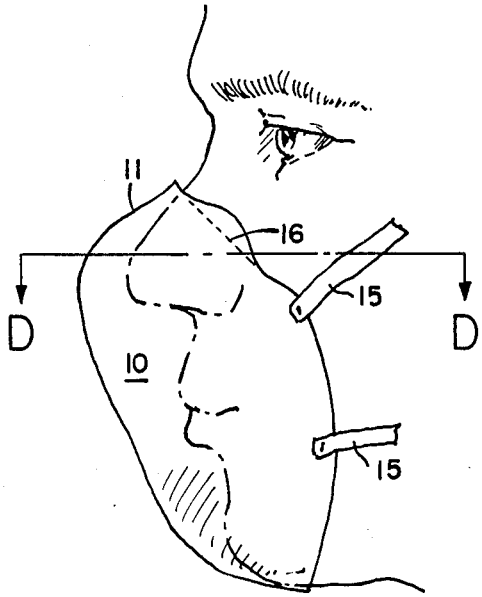
FIG. 7 is a side outline view of the mask on a wearer's face showing the novel rearward projecting portions and the clearance room inside the mask.

FIG. 1 is a front view showing the novel face mask 10 on the face of a person. Mask 10 is formed into the generally cup shaped shell shown in the other Figures and covers the mouth and nose as is seen in FIG. 1. It is not apparent in FIG. 1 but the depth of the cup of mask 10 is such that the nose has clearance room inside the mask as seen in FIG. 7. The periphery of mask 10 between the bridge of the nose and the top of the cheekbones is shaped as shown to clear safety or corrected vision glasses that the person wearing the mask may have on. This can be done because of the sealing created by the rearward projecting portions in accordance with the teaching of the present invention. The front of the mask is formed to include a number of substantially parallel rib elements 12, (with peaks 19 and valleys 20 as better shown in FIG. 2) extending vertically in the central portion of the mask as shown and, as previously mentioned, they help provide shape retention for the mask. There is also a border portion 13 extending around the periphery of the mask that is more tightly compacted and some fibers therein are fused together during forming of the mask as previously described to provide shape retention to mask 10 and to help seal mask 10 to the face of the wearer to prevent the passage of air between mask 10 and the face of the wearer. There are two elastic straps 15 fastened to mask 10 as shown in FIG. 1. These straps encircle the head of the wearer to hold mask 10 against the face.

In the preferred embodiment of the invention straps 15 are attached to border 13 of mask 10 by small staples (not shown). However, those skilled in the art realize that they may be attached in other ways such as by adhesive, or by being bonded or fused to the border of mask 10. In alternative embodiments there may be only one strap or more than two straps.

In FIG. 1 the novel rearward projecting portions in the form of outwardly formed arctuate ridges 16 on either side of the nose bridge portion of mask 10 are shown. Greater details regarding the shape of arctuate ridges 16 may be seen in other Figures. As seen in FIG. 1 outwardly formed arcuate ridges 16 are immediately adjacent to, and substantially parallel to the more highly compacted periphery or border 13 of mask 10. Outwardly formed arctuate ridges 16 are also highly compacted during the forming process. The portion of border 13 immediately adjacent to outwardly formed arctuate ridges 16 lie in the same plane as the rest of border 13, although the peaks of arctuate ridges 16 do not. This aspect of the manufacture of the novel mask 10 allows the material from which the mask is molded to be held firmly in the mold, and it is easier to trim the waste material (not shown) outside of border 13 of mask 10 since it lies in one plane. Those skilled in the art understand this.

Figure 2:
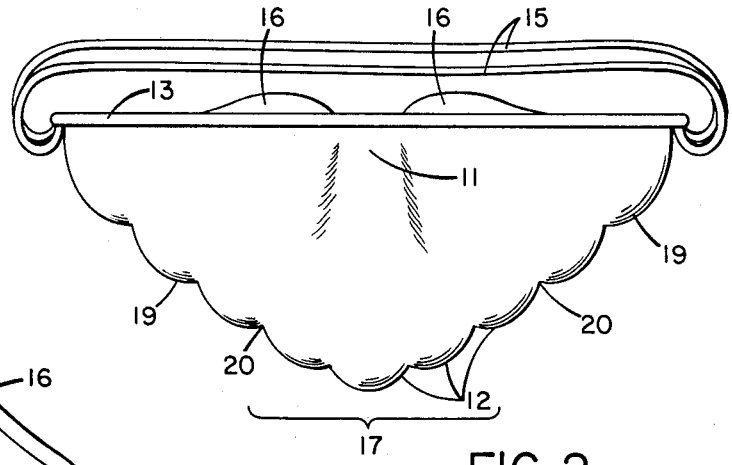
FIG. 2 is a top view of a molded or thermoformed face mask showing the novel rearward projecting portions in the form of outwardly formed arcuate ridges located on either side of the nose bridge portion of the mask, and extending rearward from the mask beyond the plane of the periphery of the mask to contour the mask to the human face in accordance with the teaching of the present invention.

In FIG. 2 is shown a top view of the novel mask 10. It is more apparent from this figure that border 13 of mask 10 lies in one plane, and that the arctuate ridges 16 project beyond border 13 toward the face of the wearer of the mask to either side of the nose bridge portion of the mask. The cup shape of mask 10 is also better appreciated after viewing both FIGS. 2 and 3. Parallel rib elements 12 located on the central portion 17 of mask 10 are also seen in this Figure.

Figure 3:
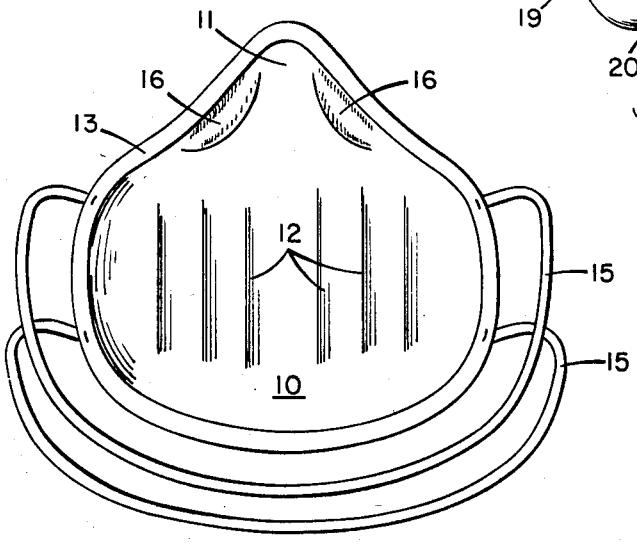
FIG. 3 is a rear view of the mask showing the novel rearward projecting portions in the form of outwardly formed arctuate ridges located on either side of the nose bridge portion of the mask, and that contour the mask to the human face in accordance with the teaching of the present invention.

FIG. 3 shows a rear view of mask 10. More details of the shape of arctuate ridges 16 are seen in this Figure. They are shaped such that in conjunction with other parts of the mask they follow the contour of a face between the bridge of the nose and the cheekbones.

Figure 4:
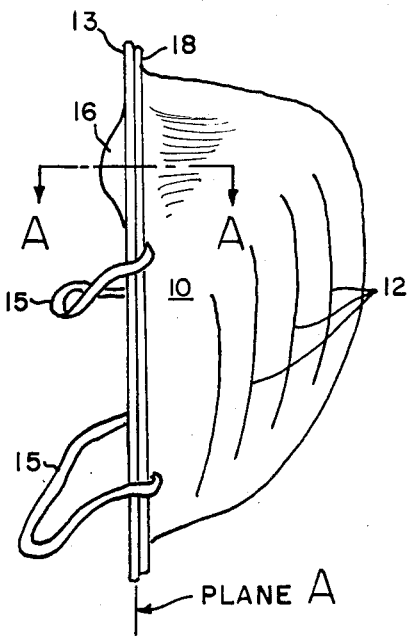
FIG. 4 is a side view of the mask showing the novel rearward projecting portions in the form of molded or thermoformed outwardly formed arctuate ridges on either side of the nose bridge area of the mask and extending to the rear of the mask beyond the plane of the periphery of the mask to contour the mask to the human face in accordance with the teaching of the present invention.

FIG. 4 is a side view of mask 10 and shows the outwardly formed arctuate ridges 16 that extend rearward from the mask beyond border 13 so that the mask particularly matches the contour of a face between the bridge of the nose and the cheekbones.

Figure 5:
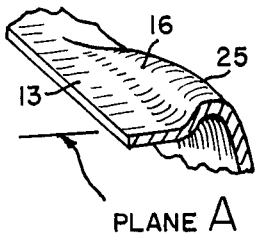
FIG. 5 is a perspective cutaway of an outwardly formed arctuate ridge having a peak and a valley of the preferred embodiment of the present invention, and showing its shape and how it extends rearward from a plane A of the periphery of the mask.

FIG. 5 is a cutaway perspective view of one of the novel outwardly formed arctuate ridges 16 of the preferred embodiment of the invention. It can be seen that arctuate ridges 16 are approximately parallel to border 13; how these arctuate ridges 16 of the preferred embodiment of the invention start in the same plane A as border 13 near the nose bridge portion, rise to a high point or peak 25 as the distance increases from the nose bridge portion, and then decreases back to the same plane A as border 13 as the cheekbone of the wearer is reached. These molded arctuate ridge portions shape the mask to the curved contour of the human face between the bridge of the nose and the cheekbones. This must be done because the surface of the face between the bridge of the nose and the cheekbones is not a straight line and doesn't lie in a plane. In addition, a thermoformed mask 10 may be easily trimmed as border 13 lies in one plane.

In an alternative embodiment of the invention, not shown in any figure, the novel rearward projecting portions or arctuate ridges 16 may be formed in mask 10 at places other than disclosed in this specification, as desired to match the contour of the face. These additional ridges may be of different length, width and height than those disclosed herein. These additional ridges will provide extra shape retention to the mask.

In another alternative embodiment of the invention a formed ridge (not shown) may be added across the nose bridge portion of the mask and near the periphery of the mask. This additional ridge could extend between the arctuate ridges to cooperate therewith to increase shape retention and to increase the spring action that holds the mask against a wearer's face over the nose and between the cheekbones.

FIG. 6 shows a sectional view of an inwardly formed, rearward projecting arcuate ridge 21, to replace arcuate ridge 16, in accordance with an alternate embodiment of the invention.

FIG. 7 is a side view of mask 10 on a wearer's face showing the rearward projecting portions 16 and the nose bridge portion 11 of the mask.

Figure 8:
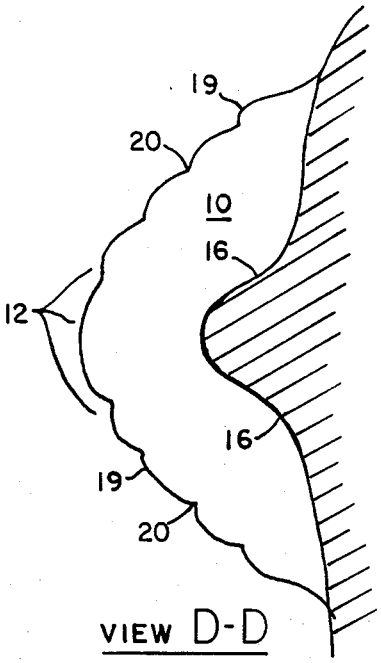
FIG. 8 is a top sectional view of the mask on a wearer's face showing the novel rearward projecting portions filling in the curved facial area between the bridge of the nose and the cheekbones.

FIG. 8 is a top sectional view of mask 10 along line D—D and showing rearward projecting portions 16, and peaks 19 and valleys 20 of rib elements 12.

Figure 9:
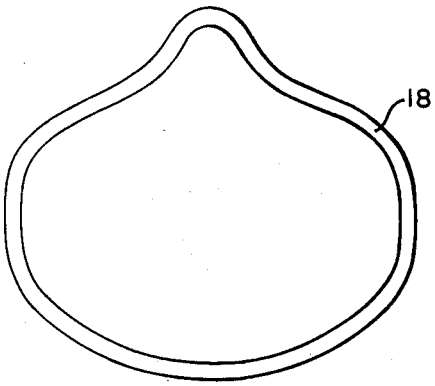
FIG. 9 is a front view of a flexible reinforcement rim that may be attached to the border of the mask.

FIG. 9 is a front view of a flexible reinforcement rim 18 which may be attached to the border 13 of mask 10.

Figure 10:
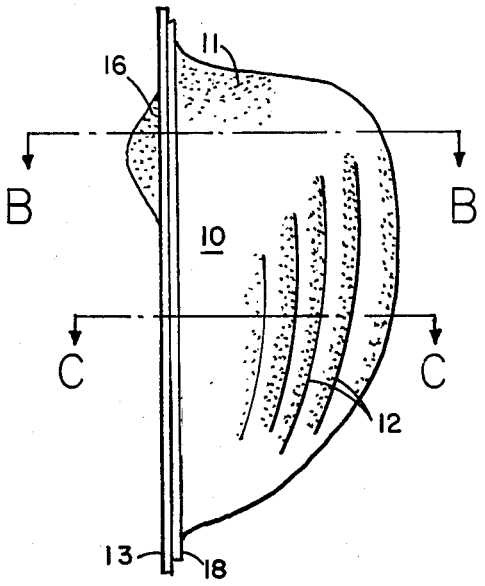
FIG. 10 is a side view of the mask showing the novel rearward projecting portions extending to the rear, a plurality of rib elements in the central area of the mask, and the flexible reinforcement rim attached to the periphery of the mask.

FIG. 10 is a side view of mask 10 showing the novel rearward projecting portions 16, a plurality of rib elements 12 in the central area of the mask, and a flexible reinforcement rim 18 attached to the periphery 13 of mask 10.

Figure 11:
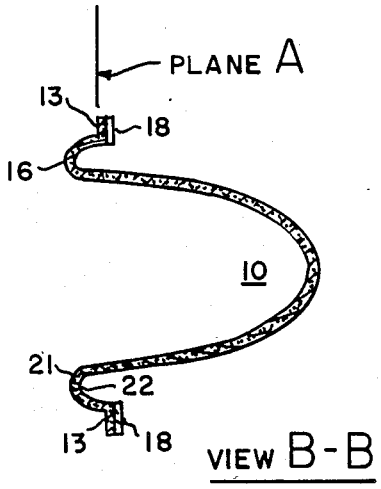
FIG. 11 is a cutaway view along line B—B showing the novel rearward projecting portions of the preferred embodiment of the invention in the form of outwardly formed arcuate ridges, the border of the mask, and a flexible reinforcement rim attached to the periphery of the mask.
Figure 12:
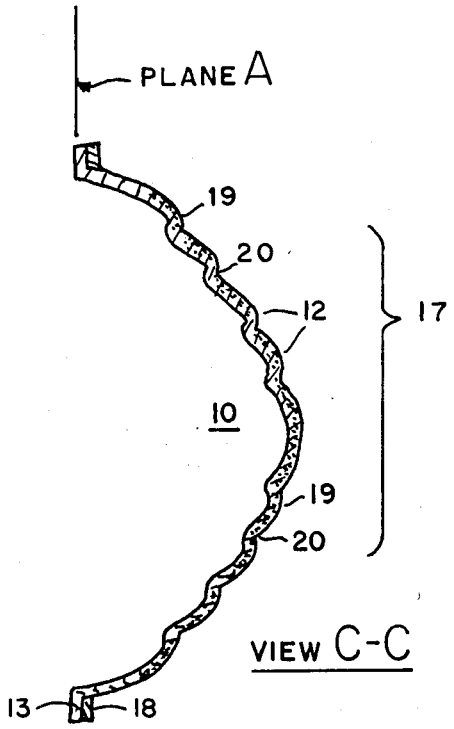
FIG. 12 is a cutaway view along line C—C showing the stiffening rib elements in the central portion of the mask shell with their peaks and valleys.

FIG. 11 is a cutaway view along line B—B of the preferred embodiment of the invention showing rearward projecting portions 16, periphery 13, and reinforcement rim 18 attached to border 13, and FIG. 12 is a cutaway view along line C—C showing the central portion 17 of mask 10, rib elements 12, and peaks 19 and valleys 20 of the rib elements 12 formed in the central portion 17 of mask 10.

While what has been described hereinabove is the preferred embodiment of the invention, it will be apparent to those skilled in the art that many modifications may be made thereto without departing from the spirit and scope of the invention. The number and direction of the plurality of rib elements on the central portion of the mask may be varied. Further, the size and number of rearward projecting portions with their peaks and valleys may be varied.

What is claimed is:

1. A flexible face mask fabricated from a single sheet of fibrous material that offers relatively low resistance to the flow of air being filtered therethrough to conform the mask to the face of a wearer, and said mask has one or more elastic straps attached to the periphery of the mask to facilitate holding the mask against the face and prevent the passage of air between the mask and the face of the wearer particularly in the area of the nose, wherein said mask comprises:

a cup shaped shell having a portion covering the nose of a wearer and a portion covering the mouth of the wearer, said nose covering portion having rearward extending projections adjacent its upper edge so that one projection is on either side of the lower portion of the nose of the wearer, said projections being formed when fabricating said mask by shaping said sheet material into an arcuate shape having substantially uniform material thickness with the fibers of said projections being more densely compacted than the rest of said nose covering portion to provide structural strength giving shape retention, said projections extend rearward from said face mask and protrude exterior from the interior of said mask beyond a plane in which the peripheral edge of said mask normally lies when said mask is not worn, and said projections lie against the face on either side of the nose when the mask is worn to thereby conform the shape of the nose portion of said mask to the contour of the face of the wearer about the nose and on either side of the lower portion of the wearer's nose so that when said mask is worn said projections do not pinch the sides of the lower portion of the wearer's nose so as to interfere with breathing, yet the straps holding the mask to the face accomplish an air seal around the periphery of the mask without having to substantially deform the mask or the face of the wearer in order to accomplish the seal.

* * * * *